US009500084B2

(12) United States Patent
Warikoo et al.

(10) Patent No.: US 9,500,084 B2
(45) Date of Patent: Nov. 22, 2016

(54) IMPELLER

(71) Applicant: Pratt & Whitney Canada Corp., Longueuil (CA)

(72) Inventors: Raman Warikoo, Oakville (CA); Hien Duong, Mississauga (CA); Jason Nichols, Mississauga (CA); Tsukasa Yoshinaka, Mount Royal (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 814 days.

(21) Appl. No.: 13/775,693

(22) Filed: Feb. 25, 2013

(65) Prior Publication Data

US 2014/0241901 A1 Aug. 28, 2014

(51) Int. Cl.

| | |
|---|---|
| ***F01D 5/14*** | (2006.01) |
| ***F01D 5/04*** | (2006.01) |
| ***F04D 29/28*** | (2006.01) |

(52) U.S. Cl.

CPC ..... *F01D 5/141* (2013.01); *F01D 5/043* (2013.01); *F04D 29/284* (2013.01)

(58) Field of Classification Search

CPC ..... F01D 5/141; F01D 5/14; F01D 5/147; F01D 5/043; F01D 5/143; F01D 5/148; F04D 29/284; F04D 29/30; F04D 29/324; F04D 29/444; F04D 29/2216; F04D 29/242; F04D 17/025; Y02T 50/673

USPC ..... 416/23 A, 223 B, 83, 185, 238, 188, 416/186 R; 415/208.2, 211.1, 211.2, 143; 417/423.1–423.14

See application file for complete search history.

(56) References Cited

U.S. PATENT DOCUMENTS

| | | | | |
|---|---|---|---|---|
| 3,011,446 A * | 12/1961 | Tsiguloff | F04D 13/10 415/191 |
| 3,904,308 A * | 9/1975 | Ribaud | F04D 21/00 415/143 |
| 4,502,837 A * | 3/1985 | Blair | F01D 5/045 415/198.1 |
| 4,543,041 A | 9/1985 | French et al. | |
| 5,525,038 A | 6/1996 | Sharma et al. | |

(Continued)

OTHER PUBLICATIONS

13775693—NPL—Virginia Tech, Solids of Revolution Definition, Slide Show.*

*Primary Examiner* — William H Rodriguez
*Assistant Examiner* — Jon Hoffmann
(74) *Attorney, Agent, or Firm* — Norton Rose Fulbright Canada LLP

(57) ABSTRACT

An impeller for increasing the pressure of a fluid circulating in an annular fluid path, the impeller comprising: a plurality of centrifugal compressor vanes circumferentially interspaced around the axis of the annular fluid path, the plurality of compressor vanes extending from an axially-oriented inlet to a radially-oriented outlet, and each having an inner edge and a free edge, the free edge of the plurality of compressor vanes coinciding with an outer limit of the annular fluid path, and a hub having a solid-of-revolution shape centered around an axis, the hub having an outer hub surface forming an inner limit to the annular fluid path and to which the inner edge of the plurality of centrifugal vanes is secured, the outer hub surface having a portion which leans forward, forming an axial recess therein.

15 Claims, 4 Drawing Sheets

(56) References Cited

U.S. PATENT DOCUMENTS

| | | | | |
|---|---|---|---|---|
| 6,071,077 | A * | 6/2000 | Rowlands | F01D 5/141<br>416/223 A |
| 7,563,074 | B2 * | 7/2009 | Xu | F04D 29/30<br>415/173.1 |
| 7,581,925 | B2 | 9/2009 | Xu et al. | |
| 7,896,618 | B2 * | 3/2011 | Higashimori | F04D 29/30<br>416/185 |
| 2010/0098546 | A1 * | 4/2010 | Emmerson | B23P 15/006<br>416/213 R |
| 2014/0314557 | A1 * | 10/2014 | Hiradate | F04D 29/284<br>415/203 |

* cited by examiner

IMPELLER

TECHNICAL FIELD

The application relates generally to the field of gas turbine engines and, more particularly, to impellers of centrifugal compressors.

BACKGROUND OF THE ART

Centrifugal compressors are used in various types of gas turbine engines, such as turboprop and turboshaft engines for instance. Overall engine requirements exert a motivation for impeller designs to be optimized for lower weight and reduced axial space. Because of this, modern day impellers tend to have thinner back plate support (the back plate being a radially extending portion of the hub which supports the outlet, or exducer, portion of the vanes, and the support being the radially-inner portion thereof). In turn, thinner back plates can lead to a support which is not as rigid, and can thus involve larger axial tip deflections when running at high speeds. To accommodate larger tip deflections, the tip clearance was increased, which lead to poorer aerodynamic performance and operability.

Accordingly, there remains room for improvement in addressing tip axial deflections at the outlet of centrifugal compressor impellers.

SUMMARY

In one aspect, there is provided an impeller for increasing the pressure of a fluid circulating in an annular fluid path, the impeller comprising: a plurality of centrifugal compressor vanes circumferentially interspaced around the axis of the annular fluid path, the plurality of compressor vanes extending from an axially-oriented inlet to a radially-oriented outlet, and each having an inner edge and a free edge, the free edge of the plurality of compressor vanes coinciding with an outer limit of the annular fluid path, and a hub having a solid-of-revolution shape centered around an axis, the hub having an outer hub surface forming an inner limit to the annular fluid path and to which the inner edge of the plurality of centrifugal vanes is secured, the outer hub surface having an orientation angle with respect to the axis which varies between the inlet and the outlet by gradually increasing to reach 90°, passes 90° forming an axial recess in the outer hub surface, and then decreases.

In a second aspect, there is provided an impeller for increasing the pressure of a fluid circulating in an annular fluid path of a gas turbine engine, the impeller comprising a hub having a solid-of-revolution shape centered around an axis of the annular fluid path, having a front end corresponding to an axial inlet of the annular fluid path and a back end, opposite the front end, the hub having an outer hub surface from which a plurality of centrifugal compressor vanes protrude, the centrifugal compressor vanes being circumferentially interspaced from one another around the axis of the annular fluid path, the hub surface curving radially-outward as it extends from the axial inlet along the annular fluid path, runs up along a side of a plate portion of the hub, and subsequently reaches a radially-oriented outlet, said hub surface having a portion which leans toward the front end and forming a downstream portion of an axial recess in the hub surface.

In a third aspect, there is provided a gas turbine engine having an annular fluid path leading to a combustor, and an impeller for increasing the pressure of a fluid circulating in the annular fluid path upstream of the combustor, the impeller having a hub having a solid-of-revolution shape centered around an axis of the annular fluid path, having a front end corresponding to an axial inlet of the annular fluid path and a back end, opposite the front end, the hub having an outer hub surface corresponding to an inner-limit of the annular fluid path and from which a plurality of centrifugal compressor vanes protrude to an outer limit of the annular fluid path, the centrifugal compressor vanes being circumferentially interspaced from one another around the axis of the annular fluid path, the hub surface curving radially-outward as it extends from the axial inlet along the annular fluid path, runs up along a side of a plate portion provided at the back end of the hub, and subsequently reaches a radially-oriented outlet, said hub surface having a portion which leans toward the front end and forming a downstream portion of an axial recess in the hub surface.

Further details of these and other aspects of the present invention will be apparent from the detailed description and figures included below.

DESCRIPTION OF THE DRAWINGS

Reference is now made to the accompanying figures, in which.

DETAILED DESCRIPTION

Figure 1:
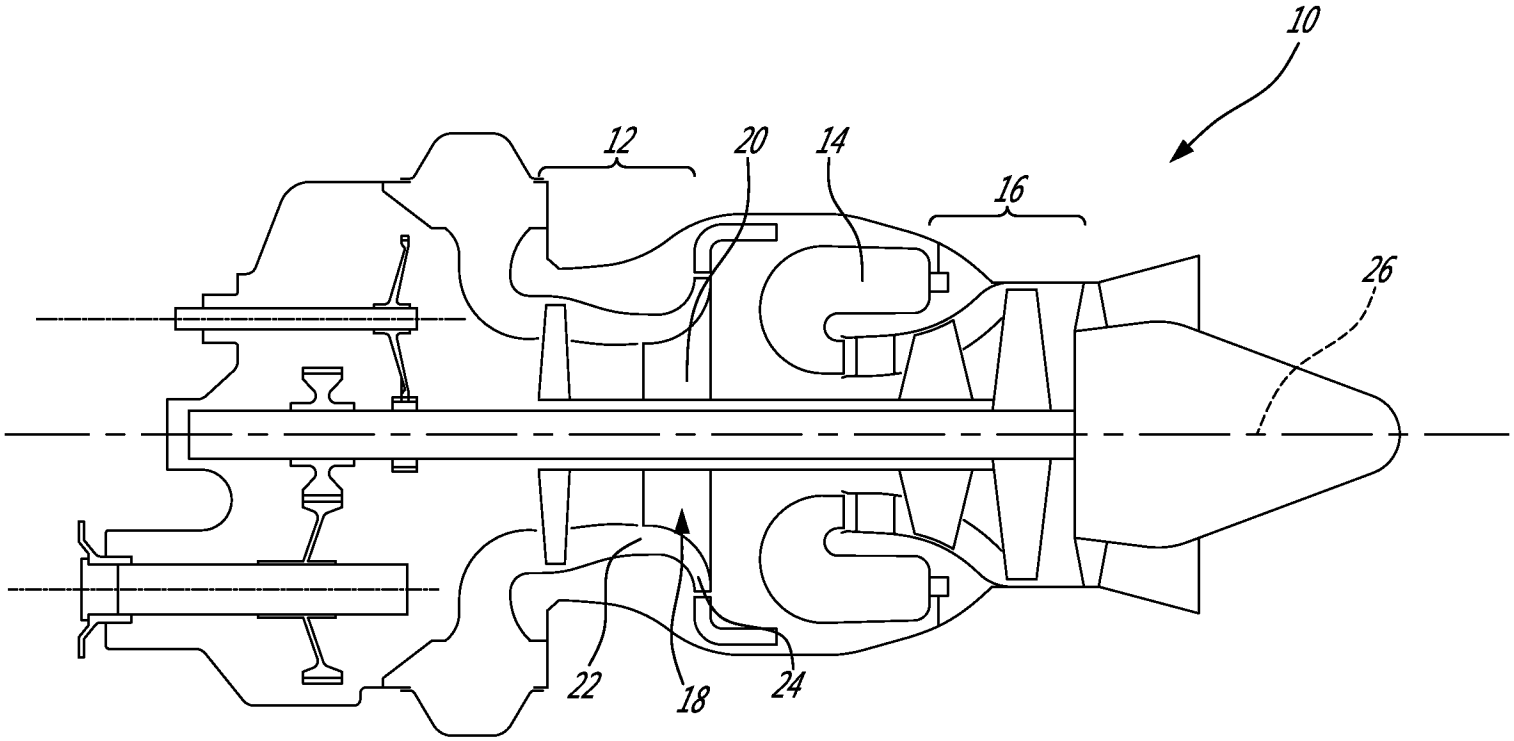
FIG. 1 PRIOR ART
FIG. 1 is a schematic cross-sectional view of a gas turbine engine.

FIG. 1 illustrates an example of a turbine engine. In this example, the turbine engine 10 is a turboshaft engine generally comprising in serial flow communication, a multistage compressor 12 for pressurizing the air, a combustor 14 in which the compressed air is mixed with fuel and ignited for generating an annular stream of hot combustion gases, and a turbine section 16 for extracting energy from the combustion gases. The turbine engine terminates in an exhaust section.

The multistage compressor 12 includes a centrifugal compressor section 18 having an impeller 20 having an axial inlet 22, or inducer, and a radial outlet 24, or exducer, and is used in increasing the pressure of the air circulating an annular fluid path upstream of the combustor 14. The annular fluid path, multistage compressor 12, and turbine section 16 are centered around a main axis 26 of the turbine engine 10.

Figure 2:
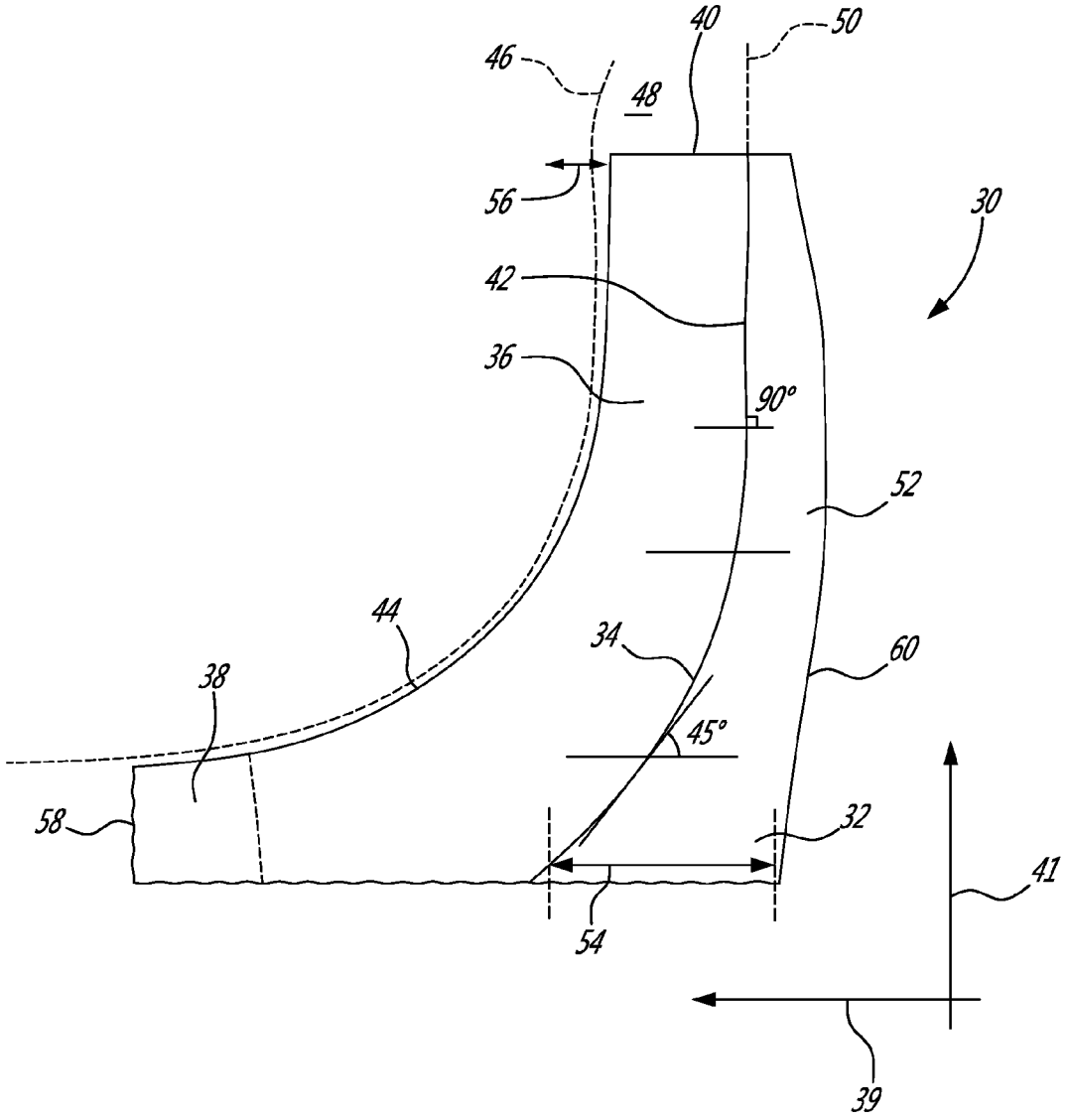
FIG. 2 PRIOR ART
FIG. 2 is a cross-sectional view, fragmented, of an impeller in accordance with the prior art.

FIG. 2 illustrates an impeller 30 in accordance with the prior art. The impeller 30 has a hub 32 having a solid-of-revolution shape centered around the axis 26 of the turbine engine (see FIG. 1). The hub 32 has an outer hub surface 34 which receives a plurality of vanes 36 circumferentially interspaced around the axis 26. The vanes 36 extend from the inlet 38 which is roughly oriented along an axial axis 39 to the outlet 40 which is oriented along a radial axis 41, and each have an inner edge 42 connecting the hub 32, and a free outer edge 44. The free outer edge 44 can be said to coincide with an outer limit 46 of the annular fluid path 48 whereas the hub surface 42 can be said to form an inner limit 50 to the annular fluid path 48.

The outer hub surface 34 can be seen to have an orientation which varies between the inlet 38 and the outlet 40. More particularly, the orientation angle of the hub surface relative the axial orientation gradually varies from around 0° (axially-oriented) at the inlet, and reaches around 90° (radially-oriented) at the outlet, passing by 45° somewhere in between.

The back plate 52 can be seen as being a disc-like portion of the hub 32 which supports the vanes 36 of the impeller 30 in the vicinity of the outlet 40. As detailed above, reducing the back plate support thickness 54 with a view to improving weight or space considerations results in lower mechanical support and can lead to an increased amount of impeller tip axial deflections (exaggerated at 56) in the engine running condition.

Impeller tip axial deflections 56 can be caused by

Forward deflections due to centrifugal (weight) forces and/or

Forward deflections due to thermal forces (In this application, "forward" refers to axial deflection in the direction of the inlet 38 [i.e. the axial direction], associated with a front end 58 of the impeller 30, whereas the expression "rearward" refers to axial deflection in the direction opposite the inlet 38, associated with a rear end 60 of the impeller 30.)

These deflections are sometime referred to as impeller "nodding". The inventors have found that these deflections may be addressed by making some changes to the impeller. One way to reduce impeller nodding is to lean the back plate 52, and more particularly the hub surface 34 thereof, forward, such as in the impeller design 130 shown in FIG. 3. This "forward lean" 164 forms an arch shape 162 which can add mechanical resistance. In the engine running condition, the forward lean 164 can act as a counter force to the impeller nodding, and can allow reaching much lower tip deflections 156 in the axial orientation 139 which, in turn, can facilitate clearance design management.

Figure 3:
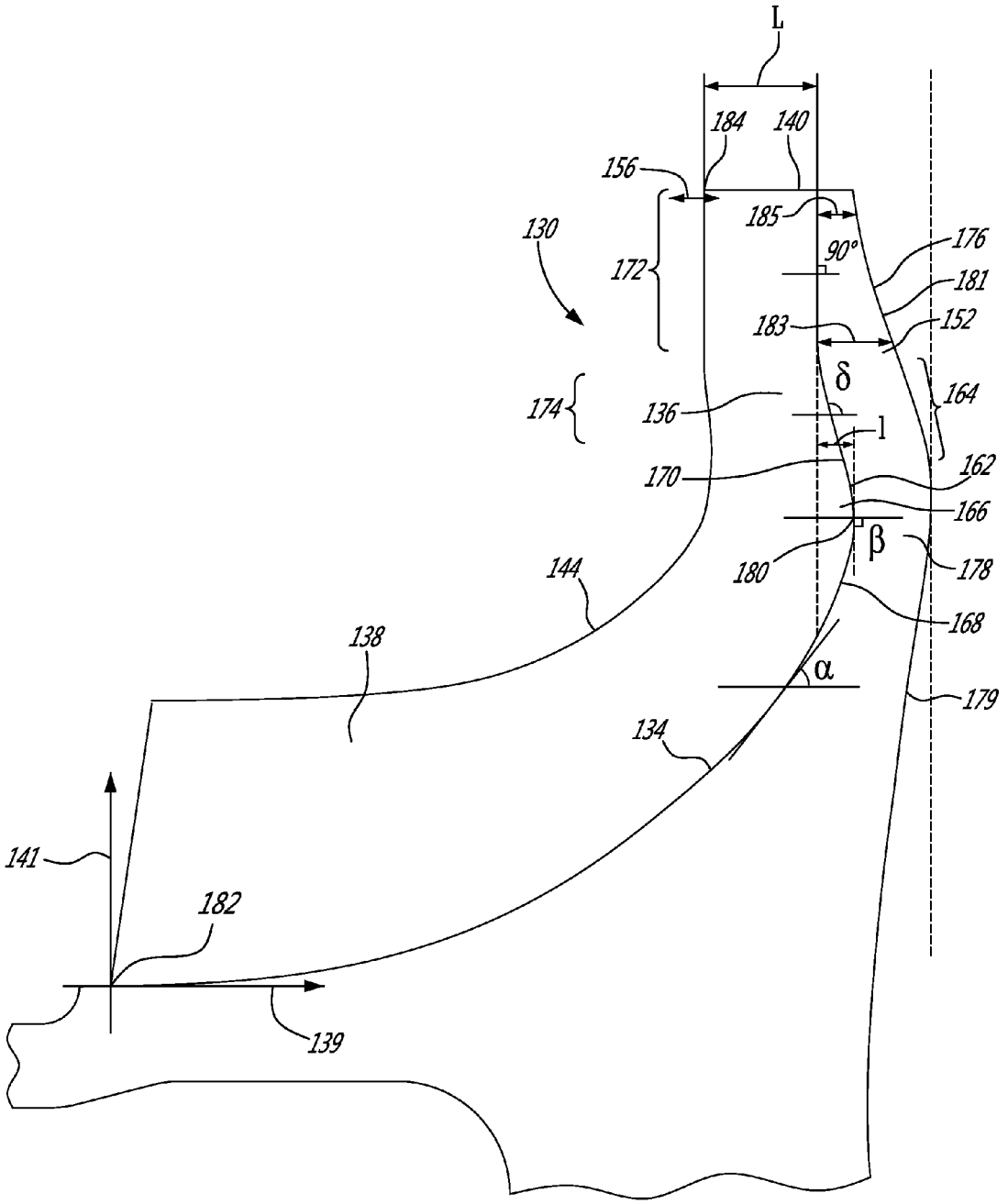
FIG. 3 is a cross-sectional view, fragmented, of a first embodiment of an improved impeller.

Turning to FIG. 3, an example of an impeller 130 having a forward lean configuration is shown. More specifically, the angle the hub surface 134 defines with the axial orientation 139 varies between the axial inlet 138 and the radial outlet 140. The orientation starts roughly axially, i.e. 0°, and then gradually increases as shown on the figure to reach an angle $\alpha$ of roughly 45°, and then an angle $\beta$ of 90° (radial orientation). One characterizing feature of the forward lean configuration is that the angle of the hub surface 134 continues to increase once it has reached 90° to reach an angle $\gamma$ which is greater than 90°, forming an axial recess 166 (delimited by a dashed line) in the outer hub surface 134. In this embodiment, the angle then gradually decreases to reach roughly 90° (which corresponds to the radial orientation 141), at a roughly radially oriented portion 172 of the hub surface 134 leading to the outlet 140. The axial recess 166 corresponds to an arch 162 in the back plate 152 which provides additional mechanical structure to hold the portion of the vanes 136 which is adjacent the outlet 140 and control axial tip deflections 156. The axial recess 166 can be said to have an upstream portion 168 and a downstream portion 170.

In designing a forward lean impeller 130 such as the one described above, designers can actually begin their work by designing the back plate 152, and more particularly the profile of the hub surface 134, and the shape of the profile of the vanes 136 can be designed in a subsequent step as a function of the hub surface 134. This new way of designing impellers represents a paradigm shift because traditional impellers were designed by designing the vane profile first to provide a smooth aerodynamic transition between the axial inlet 38 and the radial outlet 40, whereas the shape of the back plate 52 was designed subsequently to provide adequate support to the vanes 36.

Notwithstanding the above, in the embodiment shown in FIG. 3, the free edge 144 of the vanes 136 also has an optional forward lean 174 which can be used, for instance, to cooperate with the forward lean 164 of the hub surface 134 in providing mechanical structure to the vanes 136 adjacent the outlet 140. Moreover, it will be noted that the rear surface 176 of the back plate 152 also forms an arch 178 in the vicinity of the axial recess 166 in the hub surface 134, with a radially outer forward lean 181 and a radially-inner backward lean 179, and this arch 178 can also collaborate with the forward lean 164 of the hub surface 134 in providing mechanical structure to the vanes 136 adjacent the outlet 140. It will also be noted that as shown in FIG. 3, the axial thickness of the back plate 152 gradually decreases along the radially outer portion from the arch 178 to the outlet 140 (e.g. from axial thickness 183 to axial thickness 185).

In alternate embodiments, the radial coordinates of the point 180 at which the hub surface 134 reaches and passes the angle of 90° can vary and depart from the embodiment illustrated. For instance, the change in hub curvature, compared to a traditional hub profile, can begin at around 30% normalized radius (0% normalized radius corresponding to the radius of the hub at the inlet tip 182 and 100% corresponding to and the radius at the outlet vane tip 184) instead of at around 50% normalized radius as illustrated in FIG. 3, or alternately begin at a normalized radius of more than 50%. The forward leaning portion 164, can be defined as the portion of the impeller trailing edge where the hub profile has an angle exceeding 90°, and can be said to axially extend along the length l. In alternate embodiments, the length l can represent between 10% and 80% of the impeller trailing edge axial length L for instance.

Figure 4:
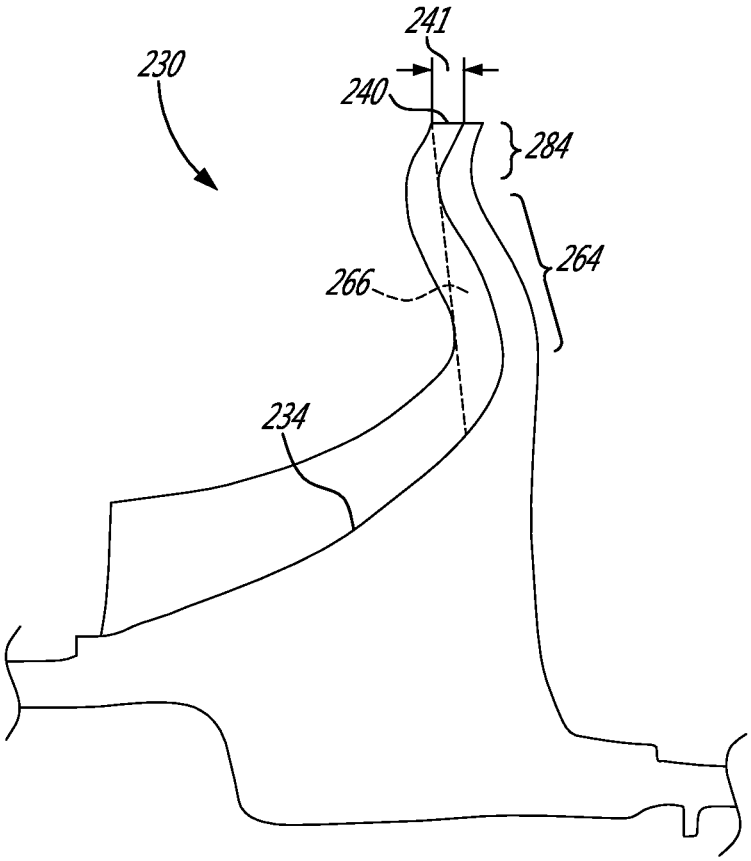
FIG. 4 is a cross-sectional view, fragmented, of a second embodiment.

FIG. 4 shows another embodiment of an impeller 230 having a forward lean 264 configuration which forms an axial depression 266 in the hub surface 234. Moreover, the forward lean 264, in this case, leads to a backward lean portion 284 which, in turn, leads to the outlet 240. The backward lean portion 284 can be said to have an axial length 241 and to correspond to the portion having less than 90° downstream of said decrease of the orientation angle. As illustrated, a backward lean 284 can also be useful in forming an additional arch structure. If used, the backward lean can extend between 0 to 50% of the impeller trailing edge length.

The above description is meant to be exemplary only, and one skilled in the art will recognize that changes may be made to the embodiments described without departing from the scope of the invention disclosed. Still other modifications which fall within the scope of the present invention will be apparent to those skilled in the art, in light of a review of this disclosure, and such modifications are intended to fall within the scope of the appended claims.

What is claimed is:

1. An impeller for increasing the pressure of a fluid circulating in an annular fluid path, the impeller comprising:

a plurality of centrifugal compressor vanes circumferentially interspaced around an axis of the annular fluid path, the plurality of compressor vanes extending from a generally axially-oriented inlet to a generally radially-oriented outlet, and each having an inner edge and a free edge, the free edge of the plurality of compressor vanes being adjacent to an outer limit of the annular fluid path and extending along the annular fluid path, between the inlet and the outlet, and a hub centered around the axis of the annular fluid path, the hub having an outer hub surface to which the inner edge of the plurality of centrifugal vanes is secured, the free edge of the plurality of centrifugal vanes extending away from the outer hub surface and being free from the hub, the outer hub surface having an orientation angle with respect to the axis which varies from the inlet to the outlet by gradually increasing to reach 90°, exceeds 90° forming an axial recess in a portion of the outer hub surface associated with a back plate of the hub, and then decreases into a forward lean configuration;

wherein the back plate of the hub has a rear surface forming an arch in the vicinity of the axial recess in the outer hub surface, the rear surface having a radially outer portion also having a forward lean configuration and a radially inner portion having a rearward lean configuration.

2. The impeller of claim 1 wherein the outer hub surface has a straight, radially-extending portion downstream of said decrease of the orientation angle and extending to the outlet.

3. The impeller of claim 1 wherein the axial length of the portion of the outer hub surface which has an angle exceeding 90° corresponds to between 10% and 80% of the axial length of a trailing edge of the plurality of centrifugal compressor vanes.

4. The impeller of claim 1 wherein the outer hub surface further has a portion having less than 90° downstream of said decrease of the orientation angle.

5. The impeller of claim 4 wherein the axial length of the portion having less than 90° downstream of said decrease of the orientation angle corresponds to between 0% and 50% of the axial length of a trailing edge of the plurality of centrifugal compressor vanes.

6. The impeller of claim 1 wherein the free edges of the plurality of compressor vanes also have a forward lean configuration as they reach the generally radially-oriented outlet.

7. The impeller of claim 1 wherein an axial thickness of the back plate gradually decreases along the radially outer portion from the arch to the generally radially-oriented outlet.

8. A gas turbine engine comprising:

a combustor;

an annular fluid path leading to the combustor; and an impeller for increasing the pressure of a fluid circulating in the annular fluid path upstream of the combustor, the impeller comprising a plurality of centrifugal compressor vanes circumferentially interspaced around an axis of the annular fluid path, the plurality of compressor vanes extending from an axially-oriented inlet to a radially-oriented outlet, and each having an inner edge and a free edge, the free edge of the plurality of compressor vanes being adjacent to an outer limit of the annular fluid path and extending between the inlet and the outlet, and a hub centered around the axis of the annular fluid path, the hub having an outer hub surface to which the inner edge of the plurality of centrifugal vanes is secured, the outer hub surface having an orientation angle with respect to the axis which varies from the inlet to the outlet by gradually increasing to reach 90°, exceeds 90° forming an axial recess in the outer hub surface, and then decreases into a forward lean configuration wherein the back plate of the hub has a rear surface forming an arch in the vicinity of the axial recess in the outer hub surface, the rear surface having a radially outer portion also having a forward lean configuration and a radially inner portion having a backward lean configuration.

9. The gas turbine engine of claim 8 wherein the outer hub surface has a straight, radially-extending portion downstream of said decrease of the orientation angle and extending to the outlet.

10. The gas turbine engine of claim 8 wherein the axial length of the portion of the outer hub surface which has an angle exceeding 90° corresponds to between 10% and 80% of the axial length of a trailing edge of the plurality of centrifugal compressor vanes.

11. The gas turbine engine of claim 8 wherein the outer hub surface further has a portion having less than 90° downstream of said decrease of the orientation angle.

12. The gas turbine engine of claim 11 wherein the axial length of the portion having less than 90° downstream of said decrease of the orientation angle corresponds to between 0% and 50% of the axial length of a trailing edge of the plurality of centrifugal compressor vanes.

13. The gas turbine engine of claim 8 wherein the free edges of the plurality of compressor vanes also have a forward lean configuration as they reach the generally radially-oriented outlet.

14. The gas turbine engine of claim 8 wherein an axial thickness of the back plate gradually decreases along the radially outer portion from the arch to the generally radially-oriented outlet.

15. An impeller for increasing the pressure of a fluid circulating in an annular fluid path, the impeller comprising:

a plurality of centrifugal compressor vanes circumferentially interspaced around an axis of the annular fluid path, the plurality of compressor vanes extending from a generally axially-oriented inlet to a generally radially-oriented outlet, and each having an inner edge and a free edge, the free edge of the plurality of compressor vanes being adjacent to an outer limit of the annular fluid path, and a hub centered around the axis of the annular fluid path, the hub having an outer hub surface to which the inner edge of the plurality of centrifugal vanes is secured, the outer hub surface having an orientation angle with respect to the axis which varies from the inlet to the outlet by gradually increasing to reach 90°, exceeds 90° forming an axial recess in a portion of the outer hub surface associated with a back plate of the hub, and then decreases into a forward lean configuration;

wherein the outer hub surface has a straight, radially-extending portion downstream of said decrease of the orientation angle and extending to the outlet.

* * * * *